US007236047B2

(12) United States Patent
Tachibana et al.

(10) Patent No.: US 7,236,047 B2
(45) Date of Patent: Jun. 26, 2007

(54) BAND GAP CIRCUIT

(75) Inventors: Suguru Tachibana, Kawasaki (JP); Kazuhiro Mitsuda, Kawasaki (JP); Tatsuo Kato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/260,176

(22) Filed: Oct. 28, 2005

(65) Prior Publication Data

US 2007/0040600 A1 Feb. 22, 2007

(30) Foreign Application Priority Data

Aug. 19, 2005 (JP) ..... 2005-238729

(51) Int. Cl.
*G05F 1/10* (2006.01)

(52) U.S. Cl. ..... 327/539

(58) Field of Classification Search ..... 327/535, 327/537, 538, 539, 540, 543
See application file for complete search history.

(56) References Cited

U.S. PATENT DOCUMENTS 5,352,972 A * 10/1994 Pernici et al. ..... 323/313
5,563,504 A 10/1996 Gilbert et al.
5,867,012 A * 2/1999 Tuthill ..... 323/313
6,215,353 B1 * 4/2001 Lewyn ..... 327/538
6,819,163 B1 * 11/2004 Gregoire, Jr. ..... 327/536

FOREIGN PATENT DOCUMENTS

| | | |
|---|---|---|
| JP | 58-500045 | 1/1983 |
| JP | 05-181556 | 7/1993 |
| JP | 2001-154749 | 6/2001 |
| WO | 82/02806 | 8/1982 |

OTHER PUBLICATIONS

Mike Tuthill; "A Switched-Current, Switched-Capacitor Temperature Sensor in 0.6-μm CMOS"; IEEE Journal of Solid-State Circuits; vol. 33, No. 7, Jul. 1998.

* cited by examiner

*Primary Examiner*—Jeffrey Zweizig
(74) *Attorney, Agent, or Firm*—Arent Fox LLP

(57) ABSTRACT

A band gap circuit includes a voltage generating circuit, and a first and a second switched capacitor circuits (SCC). Operational amplifier in the first and the second SCC are connected though a coupling capacitor. Capacitance of the coupling capacitor is smaller than that of a feedback capacitor in the first SCC. A PTAT voltage is obtained by multiplying a thermal voltage by a coefficient determined based on capacitances of input capacitors and feedback capacitors in each of the first and the second SCC, and the coupling capacitor. The voltage generating circuit generates a forward bias voltage that has a negative temperature-dependency at a p-n junction. The PTAT voltage is added to the forward bias voltage to generate a reference voltage independent of temperature.

7 Claims, 4 Drawing Sheets

BAND GAP CIRCUIT

CROSS-REFERENCE TO RELATED APPLICATIONS

This application is based upon and claims the benefit of priority from the prior Japanese Patent Application No. 2005-238729, filed on Aug. 19, 2005, the entire contents of which are incorporated herein by reference.

BACKGROUND OF THE INVENTION

1. Field of the Invention

The present invention relates to a band gap (or bandgap) circuit based on a switched-capacitor technique.

2. Description of the Related Art

A band gap circuit is commonly used in analog integrated circuits (ICs) and complementary metal oxide semiconductor (CMOS) analog circuits as a reference-voltage circuit. The band gap circuit generates a constant reference voltage that is independent of temperature and power source voltage.

However, a band gap circuit utilizes a potential of a forward biased positive-negative (p-n) junction that has a negative temperature-dependency. In other words, the potential decreases as temperature increases. Therefore, a voltage that is proportional to absolute temperature (PTAT) is added to generated reference voltage to obtain a reference voltage that is independent of temperature.

The band gap circuits based on a switched capacitor technique (hereinafter, "switched-capacitor band gap circuit") are known in the art. In the switched-capacitor band gap circuit, a capacitance ratio is used to obtain a desirable PTAT voltage by multiplying a thermal voltage k·T/q by a coefficient, where q is an electrical charge of electrons, k is the Boltzmann constant, and T is absolute temperature. In an integrated circuit, the capacitance ratio can be obtained at the highest accuracy. Therefore, in the switched-capacitor band gap circuit, which uses the capacitance ratio, a desirable PTAT voltage can be obtained with high accuracy based on the thermal voltage. In other words, switched-capacitor band gap circuits can generate highly accurate reference voltage.

A switched-capacitor band gap circuit shown in FIG. 1 has been disclosed in, for example, U.S. Pat. No. 5,563,504. In the conventional switched-capacitor band gap circuit, an emitter of a positive-negative-positive (PNP) bipolar transistor Q1 is connected to a noninverting input (+) of an operational amplifier circuit OP1. A base and a collector of the PNP bipolar transistor Q1 are connected to a ground GND. An inverting input (−) of the operational amplifier circuit OP1 is connected to the ground GND via a capacitor C1.

The inverting input (−) is connected to an output of the operational amplifier circuit OP1 via a capacitor C2. A switch S1 is connected in parallel with the capacitor C2. A current source I1 is connected to the emitter of the bipolar transistor Q1 and a current source I2 is coupled between the emitter of the bipolar transistor Q1 and a positive power source Vdd via a switch S2.

The current sources I1 and I2 output currents I1 and I2 respectively. The capacitors C1 and C2 have capacitances C1 and C2 respectively. Vo is an output reference potential of the operational amplifier circuit OP1. N1 and N2 are nodes.

When a base-to-emitter voltage, which is a forward bias voltage at the p-n junction, is Vbe, a relationship between Vbe and absolute temperature T is expressed as $$Vbe=Veg-a\cdot T \tag{1}$$

where Veg is a band gap voltage (approximately 1.2 volts (V)) of silicon, and a is temperature dependency (approximately 2 mV/° C.) of Vbe.

Furthermore, a relationship between a current I of the emitter, which is a current of a diode, and Vbe is expressed as $$I=I0\ \exp(q\cdot Vbe/k\cdot T) \tag{2}$$

where q is an electrical charge of electrons, and k is the Boltzmann constant.

As shown in FIG. 1, at the beginning, the switch S1 is closed and the switch S2 is open. Since the switch S1 is closed, a potential of the node N2 is equal to an output potential of the operational amplifier circuit OP1. In addition, since the switch S2 is open, the current I1 flows through the PNP bipolar transistor Q1. A potential of the node N2 is Vbe1 when the base-to-emitter voltage is Vbe1. Consequently, an electrical charge that can be accumulated at the node N2 while the switch S1 is closed is C1×Vbe1.

Then, the switch S1 is opened and the switch S2 is closed. As the switch S1 is open, the electrical charge of the node N2 is conserved. In addition, currents flow into the PNP bipolar transistor Q1 from both of the current sources I1 and I2. Thus, the current flowing through the PNP bipolar transistor Q1 increases from I1 to I1+I2, and the potential of the node N1 increases.

When I1+I2=m·I1 where m is a coefficient, relationships between I1 and Vbe1, and between I2 and Vbe2 are expressed as $$I1=I0\ \exp(q\cdot Vbe1/k\cdot T) \tag{3}$$

$$m\cdot I1=I0\ \exp(q\cdot Vbe2/k\cdot T) \tag{4}$$

where the base-to-emitter voltage when the current m·I1 flows through the PNP bipolar transistor Q1 is Vbe2.

By performing division on Equation 3 and Equation 4, the following Equation 5 is obtained.

$$m=\exp(q\cdot Vbe2/k\cdot T-qVbe1/k\cdot T) \tag{5}$$

When Equation 5 is solved for ΔVbe assuming Vbe2−Vbe1=ΔVbe, Equation 6 is obtained.

$$\Delta Vbe=(k\cdot T/q)\ln(m) \tag{6}$$

The potential of the node N1 increases by ΔVbe from Vbe1 to be Vbe2. Therefore, if a gain of the operational amplifier circuit OP1 is sufficiently large, the potential of the node N2 also increases by ΔVbe to be Vbe2. An output potential of the operational amplifier circuit OP1 is determined to conserve the electrical charge of the node N2. As the potential of the node N2 increases, the electrical charge of the node N2 increases. The increased amount Δq1 is expressed as $$\Delta q1=C1\cdot\Delta Vbe \tag{7}$$

On the other hand, if the output potential of the operational amplifier circuit OP1 increases, the electrical charge of the node N2 decreases. The decreased amount Δq2 is expressed as $$\Delta q2=C2(\Delta Vo-\Delta Vbe) \tag{8}$$

where the increased amount in the output potential of the operational amplifier circuit OP1 is ΔVo.

Since Δq1 and Δq2 are equal to each other, the following Equation 9 is obtained.

$$C1 \cdot \Delta Vbe = C2(\Delta Vo - \Delta Vbe) \quad (9)$$

When Equation 9 is solved for ΔVo, Equation 10 is obtained.

$$\Delta Vo = \Delta Vbe + (C1/C2)\Delta Vbe \quad (10)$$

Consequently, the output reference potential Vo of the operational amplifier circuit OP1 is finally obtained by the following Equation 11.

$$\begin{aligned} Vo &= Vbe1 + \Delta Vbe + (C1/C2) \cdot \Delta Vbe \\ &= Vbe2 + (C1/C2) \cdot \Delta Vbe \end{aligned} \quad (11)$$

The forward bias voltage Vbe2 at the p-n junction has a negative temperature-dependence as shown in Equation 1. On the other hand, ΔVbe increases in proportion to temperature as shown in Equation 6. Therefore, by setting C1/C2 at an appropriate value, the circuit can be designed so as to obtain the output reference potential Vo independent of temperature. In such a condition, Vo corresponds to a band gap voltage of silicon, and is 1.2 V. Thus, in the circuit shown in FIG. 1, it is possible to obtain a reference voltage independent of temperature by appropriately setting the circuit constant.

A circuit shown in FIG. 2 is also an example of the conventional switched-capacitor band gap circuit. As shown in FIG. 2, an emitter of a PNP bipolar transistor Q2 is connected to a noninverting input (+) of an operational amplifier circuit OP2. A base and a collector of the PNP bipolar transistor Q2 are connected to the ground GND. Moreover, an emitter of a PNP bipolar transistor Q3 is connected to an inverting input (−) of the operational amplifier circuit OP2 through a capacitor C3. A base and a collector of the PNP bipolar transistor Q3 are connected to the ground GND.

The noninverting input (+) of the operational amplifier circuit OP2 is connected to a switch S3. A capacitor C4 is coupled between the switch S3 and the inverting input (−). A switch S4 is coupled between an output of the operational amplifier circuit OP2 and the capacitor C4. A switch S5 is coupled between the output and the inverting input (−). A current sources I1 and nI1 are coupled through switches S6 and S7 respectively, between the positive power source Vdd and each of the emitters of the PNP bipolar transistor Q2 and Q3.

In the following explanation of an operation of the band gap circuit shown in FIG. 2, I1 and nI1 represent currents of the current sources I1 and nI1, C3 and C4 represent capacitances of the capacitors C3 and C4, and Vo represents an output reference potential of the operational amplifier circuit OP2. Nodes between an internal circuit and each of the noninverting input (+), the emitter of the PNP bipolar transistor Q3, and the inverting input (−) are nodes N3, N4, and N5 respectively. A node between the capacitor C4 and both of the switches S3 and S4 is a node N6. Sizes of the PNP bipolar transistors Q2 and Q3 are equal to each other.

As shown in FIG. 2, at the beginning, the switch S6 is closed on a side of the PNP bipolar transistor Q2, and the switch S7 is closed on a side of the PNP bipolar transistor Q3. The switches S3 and S5 are closed, and the switch S4 is open. The current I1 flows through the PNP bipolar transistor Q2. A base-to-emitter voltage of the PNP bipolar transistor Q2 is Vbe1. The current nI1 flows through the PNP bipolar transistor Q3. A base-to-emitter voltage of the PNP bipolar transistor Q3 is Vbe2.

Since the switch S3 is closed, a potential at the node N6 is Vbe, which is equal to a potential of the node N3. Moreover, since the switch S5 is close, a potential of the node N5 is approximately Vbe1, which is substantially equal to the potential of the node N3. It is assumed that an ideal condition in which an offset voltage becomes zero in the operational amplifier circuit OP2 is obtained. Because a potential of the node N4 is Vbe2, an electrical charge to be accumulated in the capacitor C3 is −(Vbe2−Vbe1)C3. In addition, since the potentials of the nodes N5 and N6 are equal to each other, an electrical charge to be accumulated in the capacitor C4 becomes zero. Therefore, an electrical charge to be accumulated in the node N5 is −(Vbe2−Vbe1) C3.

When the switch S5 is switched to be open in this condition, the electrical charge accumulated in the node N5 is conserved. Then, the switch S3 is switched to be open, the switch S6 is switched to be closed on a side of the PNP bipolar transistor Q3, and the switch S7 is switched to be closed on a side of the PNP bipolar transistor Q2. Furthermore, the switch S4 is switched to be closed. Thus, the current nI1 flows through the PNP bipolar transistor Q2. Therefore, the base-to-emitter voltage of the PNP bipolar transistor Q2 becomes Vbe2. On the other hand, the current I1 flows through the PNP bipolar transistor Q3. Therefore, the base-to-emitter voltage of the PNP bipolar transistor Q3 becomes Vbe1.

Since the potential of the node N3 becomes Vbe2, if a voltage gain of the operational amplifier circuit OP2 is enough large, the potential of the node N5 also becomes Vbe2. An output potential of the operational amplifier circuit OP2 is determined to conserve the electrical charge of the node N5. The electrical charge qN5 of the node N5 is expressed as $$qN5 = C3(Vbe2 - Vbe1) - (Vo - Vbe2)C4 \quad (12)$$

where Vo is output potential.

As described above, the electrical charge of the node N5 before each of the switches is switched is −(Vbe2−Vbe1)C3. Based on this, the following Equation 13 is obtained.

$$-(Vbe2 - Vbe1)C3 = C3(Vbe2 - Vbe1) - (Vo - Vbe2)C4 \quad (13)$$

When Equation 13 is solved for Vo where Vbe2−Vbe1=ΔVbe, the following Equation 14 is obtained.

$$Vo = Vbe2 + \Delta Vbe \times 2C3/C4 \quad (14)$$

In the circuit designed such that ΔVbe is generated depending on a predetermined current ratio, ΔVbe has dependency that is proportional to the absolute temperature T. Therefore, with the circuit shown in FIG. 2, it is possible to obtain a reference voltage independent of temperature by appropriately setting the circuit constant, similarly to the case with the circuit shown in FIG. 1.

Various other switched-capacitor band gap circuits are know in the art. A circuit disclosed in, for example, Japanese Patent Application Laid-Open No. H5-181556 is configured as follows. The circuit includes a first current source and a first diode element, a second current source and a second diode, a first switch, a second switch, a first capacitor, a second capacitor, a third switch, an amplifier, a fourth switch, and a third capacitor. The first current source and the first diode element are joined at a first node and connected in series between a first and a second voltage terminals. The second current source and the second diode element are joined at a second node and connected in series between the first and the second voltage terminals. The first and the second current sources have different currents. The first switch includes a first terminal selectively connectable to a second and a third terminals thereof. The second switch is selectably connected to a first, a second, and a third terminals. The second and third terminals are connected respectively to the second node and the second voltage terminal. The first capacitor includes a first terminal that is connected to the first terminal of the first switch. The second capacitor includes a first terminal that is connected to the first terminal of the second switch. Second terminals of the first and the second capacitors are connected in common to a third node. The third switch includes a first and a second terminals. The first terminal of the third switch is connected to the third node. The amplifier includes an input and an output, and the input is connected to the second terminal of the third switch. The fourth switch includes a first and a second terminals connected between the input and the output of the amplifier. The third capacitor includes a first terminal connected to the input of the amplifier and a second terminal connected to the output of the amplifier.

A circuit disclosed in, for example, Japanese Patent Application Laid-Open No. 2001-154749 is configured as follows. The circuit includes a band gap circuit, a switched capacitor circuit, and a filter. The band gap circuit outputs a bandgap output voltage from a first output terminal. The switched capacitor circuit operates in response to a control clock. The filter receives the bandgap output voltage, and outputs received bandgap output voltage to a second output terminal. The bandgap output voltage is controlled based on a frequency of the control clock.

A circuit for generating a reference voltage independent of temperature disclosed in, for example, Japanese Patent Application Laid-Open No. S58-500045 is configured as follows. The circuit includes a first and a second bipolar transistors, a clock, a first and a second switched capacitors, and an amplifier. The first and the second bipolar transistors have a predetermined base voltage. The first and the second bipolar transistors are biased to different current density, and generate a first emitter voltage and a second emitter voltage at each emitter. The clock generates a first and a second clock signals that do not overlap with each other. The first switched capacitor is coupled to the base voltage in response to the first clock signal, is coupled to the first emitter voltage in response to the second clock signal, and generates a first electrical charge relating to Vbe of the first bipolar transistor. The second switched capacitor is couple to the second emitter voltage in response to the first clock signal, is couple to the first emitter voltage in response to the second clock signal, and generates a second electrical charge relating to a difference between Vbe of the first bipolar transistor and Vbe of the second bipolar transistor. The amplifier is connected to the first and the second switched capacitors, and generates a reference voltage that is proportional to a sum of the first electrical charge and the second electrical charge. Such conventional circuit is also disclosed in, for example, *IEEE JOURNAL OF SOLID-STATE CIRCUITS,* Vol. 33, No. 7, 1998, pp. 1117-1122 titled "A Switched-Current, Switched-Capacitor Temperature Sensor in 0.6– μm CMOS" by Mike Tuthill.

As described above, in the conventional switched-capacitor band gap circuit, in multiplying the thermal voltage k·T/q by a predetermined coefficient, a capacitance ratio of a switched capacitor, for example, C1/C2 in Equation 11 and C3/C4 in Equation 14, is used as the coefficient. Generally, to obtain the capacitance ratio with high accuracy and high reproducibility in an IC, plural units of capacitors each of which has a predetermined unit capacitance are prepared. A desirable capacitance ratio is obtained by adjusting a ratio in the number of such capacitors. Therefore, the capacitance ratio, which is the coefficient, is an integer ratio. To approximate the integer ratio to a desirable coefficient, it is preferable that the integer ratio can be set more precisely. To set the integer ratio in detail, however, it is necessary to increase the number of such capacitors. The capacitors disadvantageously occupy silicon area.

SUMMARY OF THE INVENTION

It is an object of the present invention to at least solve the above problems in the conventional technology.

A band gap circuit according to one aspect of the present invention generates a reference voltage, and includes a voltage generating circuit configured to generate a voltage having negative temperature dependency; a first switched-capacitor circuit including a first operational amplifier circuit having an input terminal and an output terminal; a first input capacitor that is connected to the input terminal of the first operational amplifier circuit; and a first feedback capacitor that is connected to the input terminal and the output terminal of the first operational amplifier circuit; a second switched-capacitor circuit including a second operational amplifier circuit having an input terminal and an output terminal; a second input capacitor that is connected to the input terminal of the second operational amplifier circuit; and a second feedback capacitor that is connected to the input terminal and the output terminal of the second operational amplifier circuit; and a first coupling capacitor that capacitively couples the output terminal of the second operational amplifier circuit with the input terminal of the first operational amplifier circuit. A thermal voltage, which is a voltage proportional to absolute temperature, is multiplied by a coefficient, and multiplied thermal voltage is added to the voltage generated by the voltage generating circuit, the coefficient being determined based on capacitances of the first input capacitor, the first feedback capacitor, the first coupling capacitor, the second input capacitor, and the second feedback capacitor.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments of the present invention will be explained in detail below with reference to the accompanying drawings.

Figure 3:
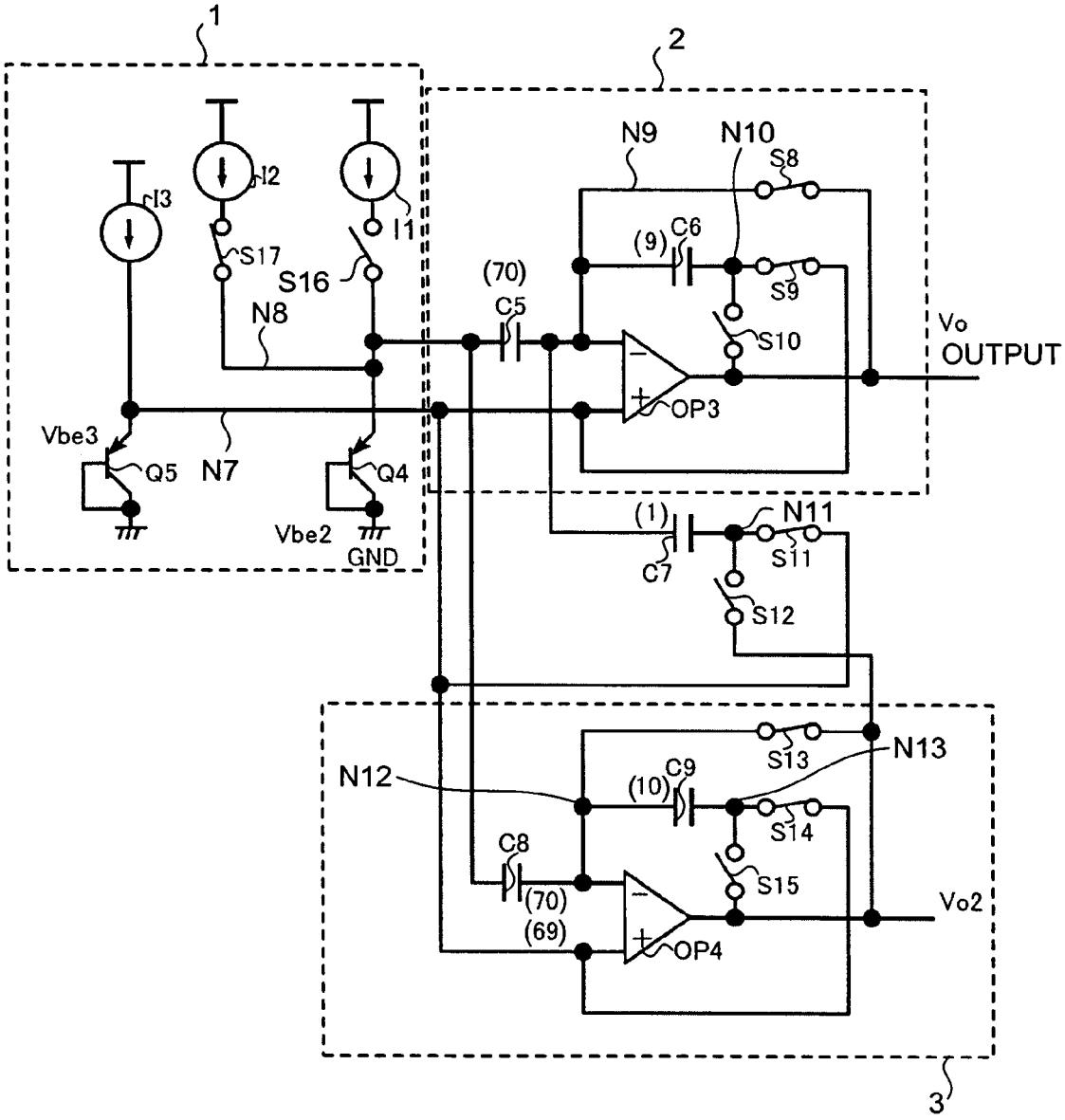
FIG. 3 is a circuit diagram of a band gap circuit according to a first embodiment of the present invention.

FIG. 3 is a circuit diagram of a band gap circuit according to a first embodiment of the present invention. The band gap circuit includes a voltage generating circuit 1, a first switched capacitor 2 and a second switched capacitor 3, and a coupling capacitor C7. The voltage generating circuit 1 generates a voltage so that a p-n junction is forward biased. The coupling capacitor C7 capacitively couples the first switched capacitor 2 and the second switched capacitor 3.

The voltage generating circuit 1 includes, for example, three current sources I1, I2, and I3, and two PNP bipolar transistors Q4 and Q5. A base and a collector of the PNP bipolar transistor Q4 are connected to the ground GND. An emitter of the PNP bipolar transistor Q4 is connected to the current source I1 through a switch S16, and to the current source I2 through a switch S17.

A base and a collector of the PNP bipolar transistor Q5 are connected to the ground GND. An emitter of the PNP bipolar transistor Q5 is connected to the current source I3. To the current sources I1, I2, and I3, a positive power is supplied from the positive power source Vdd.

The first switched capacitor circuit 2 includes an operational amplifier circuit OP3, two units of capacitors C5 and C6, and three switches S8, S9, and S10. A noninverting input (+) of the operational amplifier circuit OP3 is connected to the emitter of the PNP bipolar transistor Q5. A node between the noninverting input (+) and the emitter of the PNP bipolar transistor Q5 is a node N7. An inverting input (−) of the operational amplifier circuit OP3 is connected to the emitter of the PNP bipolar transistor Q4 through the input capacitor C5. A node between the emitter of the PNP bipolar transistor Q4 and an internal circuit is a node N8.

An output of the operational amplifier circuit OP3 is connected to the switch S10. The feedback capacitor C6 is connected between the switch S10 and the inverting input (−) of the operational amplifier circuit OP3. The switch S9 is connected between the noninverting input (+) of the operational amplifier circuit OP3 and the feedback capacitor C6. A node between the switches S9, and S10, and the feedback capacitor C6 is node N10. The switch S8 is connected between the output and the inverting input (−) of the operational amplifier circuit OP3. A node between the switch S8 and the inverting input (−) of the operational amplifier OP3 is a node N9.

The second switched capacitor circuit 3 includes an operational amplifier circuit OP4, two units of capacitors C8 and C9, and three switches S13, S14, and S15. A structure of the second switched capacitor circuit 3 is same as that of the first switched capacitor circuit 2, and the operational amplifier circuit OP4, the capacitors C8 and C9, and the switches S13, S14, and S15 correspond to the operational amplifier circuit OP3, the capacitors C5 and C6, and three switches S8, S9, and S10 in the first switched capacitor circuit 2. Moreover, nodes N12 and N13 correspond to the nodes N9 and N10.

An output of the operational amplifier circuit OP4 is connected to the switch S12. The coupling capacitor C7 is connected between the switch S12 and the inverting input (−) of the operational amplifier circuit OP3. A capacitance of the coupling capacitor C7 is smaller than a capacitance of the feedback capacitor C6. A node between the switch S12 and the coupling capacitor C7 is a node N11. Between the node N11 and the node N7, which is between the noninverting input (+) of the operational amplifier circuits OP3 and OP4, the switch S11 is connected. The switches S8 to S17 are formed with, for example, MOS transistors.

In the following explanation of the band gap circuit shown in FIG. 3, I1, I2, and I3 represent currents of the current sources I1, I2, and I3 respectively. C5, C6, C7, C8, and C9 represent capacitances of the input capacitor C5, the feedback capacitor C6, the coupling capacitor C7, the input capacitor C8, and the feedback capacitor C9 respectively. Moreover, Vo represents an output reference potential of the operational amplifier circuit OP3, and Vo2 represents an output potential of the operational amplifier circuit OP4. Vo is a potential of the internal circuit required for generating Vo. It is assumed that an offset voltage is zero in the operational amplifier circuits OP3 and OP4, and the sizes of the PNP bipolar transistors Q4 and Q5 are equal to each other.

As shown in FIG. 3, at the beginning, the switches S8, S9, S11, S13, S14, and S17 are closed, and the switches S10, S12, S15, and S16 are open. Since the switch S17 is closed and the switch S16 is open, the current I2 flows through the PNP bipolar transistor Q4.

When a base-to-emitter voltage of the PNP bipolar transistor Q4 is Vbe2, a potential of the node N8 is Vbe2. The current I3 flows through the PNP bipolar transistor Q5. When a base-to-emitter voltage of the PNP bipolar transistor Q5 is Vbe3, a potential of the node N7 is Vbe3. Since the switch S8 is closed, a potential of the node N9 is equal to an output potential of the operational amplifier circuit OP3. Because the potential of the node N7 and a potential of the node N9 are substantially equal to each other, the potential of the node N9 is substantially Vbe3. Since the switch S9 is closed, a potential of the node N10 becomes equal to that of the node N7, which is Vbe3.

Since the switch S13 is closed, a potential of the node N12 is equal to an output potential of the operational amplifier circuit OP4. Moreover, because the potentials of the nodes N7 and N12 are substantially equal to each other, the potential of the node N12 is substantially Vbe3. Since the switch S14 is closed, a potential of the node N13 becomes equal to that of the node N7, which is Vbe3.

Because the potentials of the nodes N9 and N10 are equal, an electrical charge to be accumulated in the feedback capacitor C6 is zero. In addition, because the potential of the node N8 is Vbe2 and the potential of the node N9 is Vbe3, an electrical charge to be accumulated in the input capacitor C5 is (Vbe3−Vbe2)C5. Therefore, an electrical charge qN9 to be accumulated at the node N9 is expressed as $$qN9=(Vbe3-Vbe2)C5 \tag{15}$$

Since both of potentials at both ends of the coupling capacitor C7 are Vbe3, an electrical charge to be accumulated in the coupling capacitor C7 is zero. Since the potentials of the nodes N12 and N13 are equal to each other, an electrical charge to be accumulated in the feedback capacitor C9 is zero. Moreover, since the potential of the node N8 is Vbe2 and the potential of the node N12 is Vbe3, an electrical charge to be accumulated in the input capacitor C8 is (Vbe3−Vbe2)C8. Therefore, an electrical charge qN12 to be accumulated in the input capacitor C8 is expressed as $$qN12=(Vbe3-Vbe2)C8 \tag{16}$$

The switches S8, S9, S11, S13, S14, and S17 are switched off to be open. Then, the switches S10, S12, S15, and S16 are switched on to be closed. Since the switches S8 and S13 are open, the electrical charges at the nodes N9 and N12 are conserved. In addition, the current I1 flows through the PNP bipolar transistor Q4. The base-to-emitter voltage of the PNP bipolar transistor Q4 is Vbe1.

When I2=j·I1 (where j is a coefficient) is satisfied, the base-to-emitter voltage of the PNP bipolar transistor Q4 while a current j·I1 is flowing therethrough is Vbe2. Therefore, by setting the current sources I1 and I2 to be I1<I2, the electric potential at the node N8 becomes Vbe1 from Vbe2. When ΔVbe=Vbe2−Vbe1 is satisfied, The following Equation 17 is obtained from Equation 16.

$$\Delta Vbe=(k\cdot T/q)\ln(j) \tag{17}$$

On the other hand, since the electric potential at the node N7 does not change, if a gain of the operational amplifier circuit OP3 is sufficiently large, the electrical charge at the node N9 also remains to be Vbe3. Thus, the output potential of the operational amplifier circuit OP3 is determined so that the electrical charge of the node N9 is conserved. In a similar manner, if a gain of the operational amplifier circuit OP4 is sufficiently large, the electrical charge at the node N12 remains to be Vbe3, the output potential of the operational amplifier circuit OP4 is determined so that the electrical potential of the node N12 is conserved.

Suppose that the electrical charge of the node N8 decreases by ΔVbe, and the output potential of the operational amplifier OP4 increases from Vbe3 to Vo2. If the electrical charge at the node N12 is acquired in this condition, supposing that the electrical charge qN12 of the node N12 in Equation 16 is conserved, the following Equation 18 is obtained.

$$(Vbe3-Vbe1)C8-(Vo2-Vbe3)C9=(Vbe3-Vbe2)C8 \tag{18}$$

When Equation 18 is solved for Vo2 where Vbe2−Vbe1=ΔVbe, the following Equation 19 is obtained.

$$Vo2=Vbe3+\Delta Vbe\times C8/C9 \tag{19}$$

Based on Equation 19, Vo2 can be determined. The electrical charge of the node N18 decreases by ΔVbe, and the output potential of the operational amplifier circuit OP4 increases from Vbe3 to Vo2 shown in Equation 19. Moreover, suppose that the output potential of the operational amplifier circuit OP3 increases from Vbe3 to Vo. If the electrical charge of the node N9 is acquired in this condition, supposing that the electrical charge qN9 of the node N9 in Equation 15 is conserved, the following Equation 20 is obtained.

$$(Vbe3-Vbe1)C5-(Vo-Vbe3)C6-(Vo2-Vbe3)C7=(Vbe3-Vbe2)C5 \tag{20}$$

When Equation 20 is solved for Vo where Vo2−Vbe3=ΔVbe×C8/C9, the following Equation 21 is obtained.

$$Vo=Vbe3+\Delta Vbe\times C5/C6-\Delta Vbe\times(C7C8)/(C6C9) \tag{21}$$

Based on Equation 21, Vo can be determined. Vbe3 of the forward bias voltage at the p-n junction has the negative temperature-dependency in which the voltage decreases as temperature increases. On the other hand, ΔVbe increases in proportion to temperature as shown in Equation 17. Therefore, by appropriately setting values of C5/C6 and (C7C8)/(C6C9), it is possible to design the circuit such that the output reference potential Vo of the operational amplifier circuit OP3 is independent of temperature. In this case, Vo corresponds to a bandgap voltage of silicon, which is approximately 1.2 V.

Thus, according to the band gap circuit shown in FIG. 3, it is possible to obtain the reference value independent of temperature by appropriately setting the circuit coefficient. In addition, even if the total number of capacitors is equivalent to or smaller than that of the conventional technology, it is possible to set the coefficient (capacitance ratio) by which ΔVbe is multiplied, that is, the coefficient by which the thermal voltage (k·T/q) is multiplied, more precisely.

Figure 1:
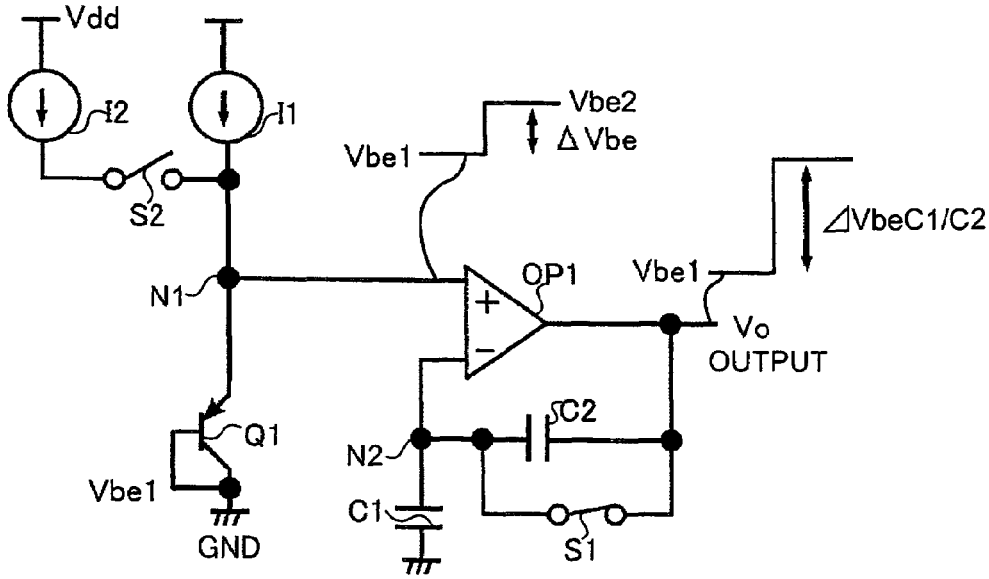
FIG.1 PRIOR ART
FIG. 1 is a circuit diagram of a conventional band gap circuit.
Figure 2:
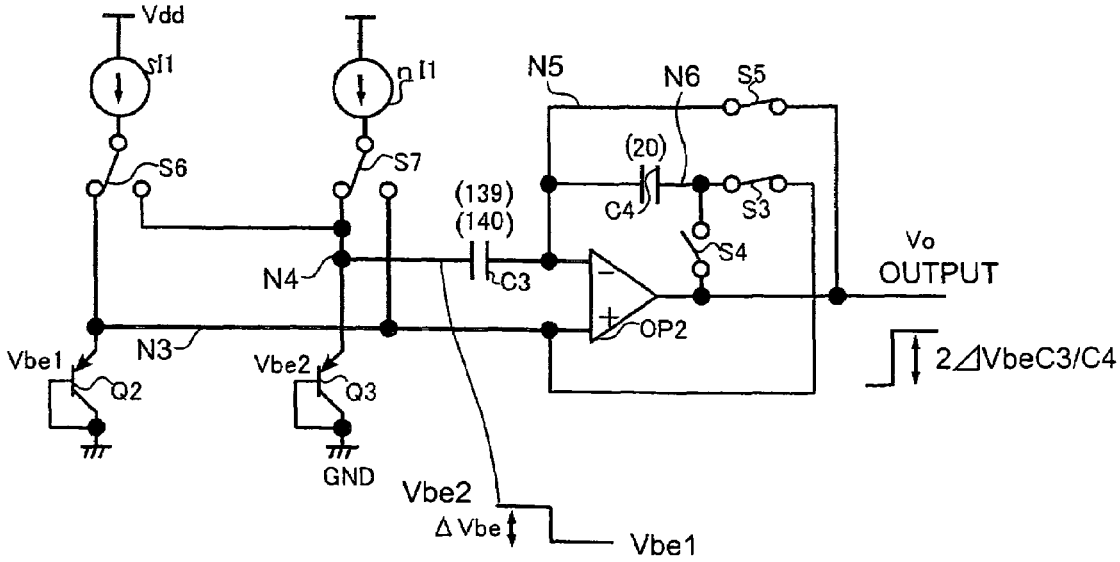
FIG.2 PRIOR ART
FIG. 2 is a circuit diagram of another conventional band gap circuit.

The band gap circuit according to the first embodiment shown in FIG. 3 and the conventional band gap circuit shown in FIG. 2 are compared in how precise the coefficient, by which the thermal voltage (k·T/q) is multiplied, can be set when the total number in unit capacitance is identical to each other. Suppose a capacitance ratio equal to or larger than a ratio of 7:1 is required in both of the circuits for a conveniences' sake, although capacitance ratios to be required in an actual use are different in the circuits shown in FIG. 3 and FIG. 2 because of different configurations. A capacitance of each of the capacitors shown in FIG. 3 and FIG. 2 is indicated in the number in unit capacitance (hereinafter, "capacitance") in brackets shown near each of the capacitors.

For example, when capacitances of the capacitors C3 and C4 shown in FIG. 2 are 140 and 20 respectively, the total capacitance is 160. Therefore, the capacitance ratio by which ΔVbe is multiplied is C3/C4=140/20=7. If the capacitance ratio should be modified as a result of measurement, the capacitance ratio can be modified by changing, for example, the capacitance of the capacitor C3 to 139. Thus, the capacitance ratio can be changed to C3/C4=139/20. Difference between the capacitance ratios when the capacitance of the capacitor C3 is 140 and 139 is 140/20−139/20=0.05.

When capacitances of the input capacitor C5, the feedback capacitor C6, the coupling capacitor C7, the input capacitor C8, and the feedback capacitor C9 are 70, 9, 1, 70, and 10 respectively, the total capacitance is 160. The capacitance ratio by which ΔVbe is multiplied is C5/C6−(C7C8)/(C6C9) as indicated in Equation 21. Therefore, the capacitance ratio is 70/9−(1×70)/(9×10)=7.7778−0.7778=7.

If this capacitance ratio should be modified as a result of measurement, the capacitance ratio can be modified by changing, for example, the capacitance of the input capacitor C8 to 69. Thus, the capacitance ratio can be changed to 70/9−(1×69)(9×10O)=7.7778−0.7667=7.011. Therefore, a difference between the capacitance ratios is |7−7.011|=0.01. This is ⅕ of the difference between the capacitance ratios in the conventional band gap circuit shown in FIG. 2. In other words, in the band gap circuit according to the first embodiment, the coefficient, by which the thermal voltage (k·T/q) is multiplied, can be set in more precise value than that in the conventional band gap circuit.

Figure 4:
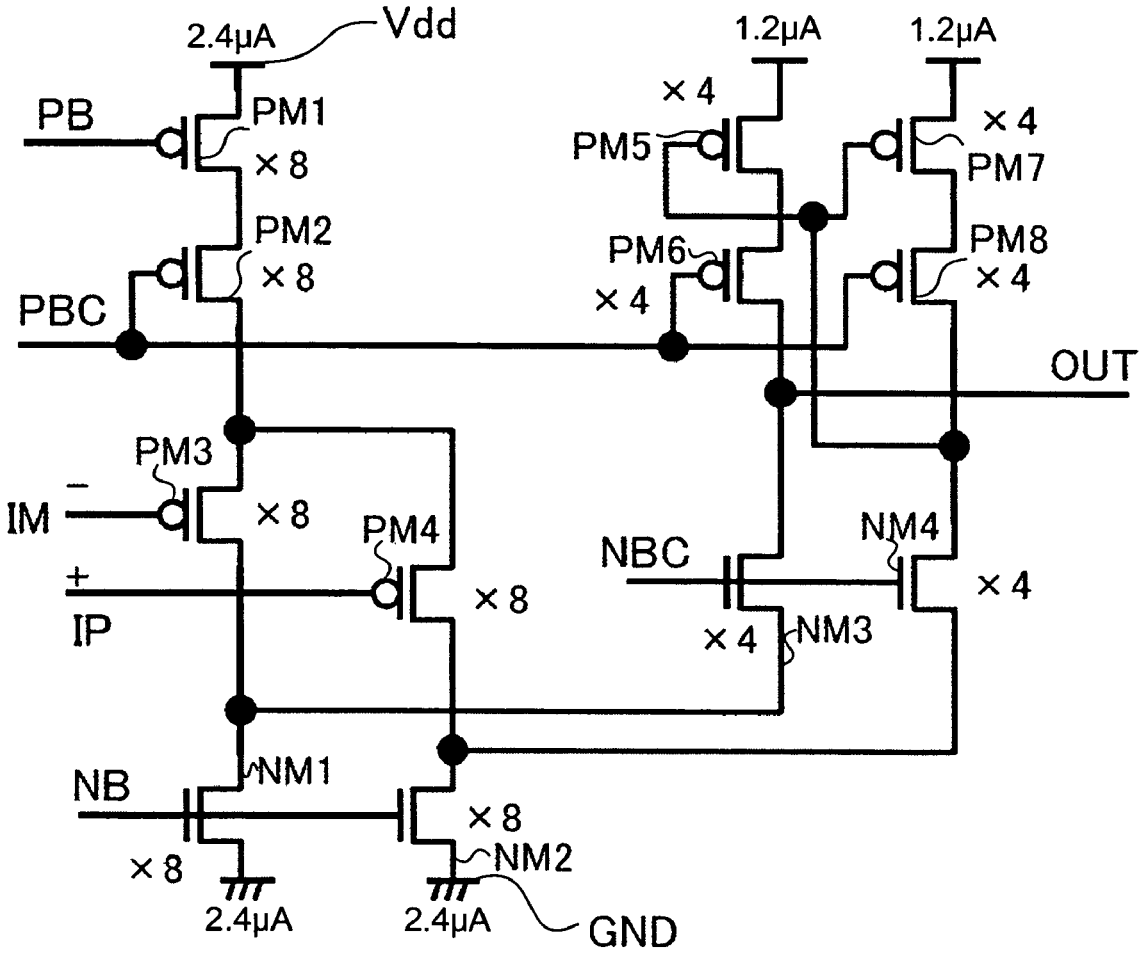
FIG. 4 is a circuit diagram of an operational amplifier circuit.

FIG. 4 is a circuit diagram of the operational amplifier circuit OP3 and the operational amplifier circuit OP4. As shown in FIG. 4, the operational amplifier OP3 and the operational amplifier circuit OP4 are, for example, of a folded cascode type, although not particularly limited. This type of operational amplifier circuit includes a constant current source, a folded cascode circuit, and a current mirror circuit. The constant current source is formed with positive-channel metal-oxide semiconductor (PMOS) transistors PM1 and PM2, and negative-channel metal-oxide semiconductor (NMOS) transistors NM1 and NM2. The folded cascode circuit is formed with PMOS transistors PM3 and PM4, and NMOS transistors NM3 and NM4. The current mirror circuit is formed with PMOS transistors PM5, PM6, PM7, and PM8.

Vdd, GND, and OUT shown in FIG. 4 represent the positive power source, and the ground respectively. IM and IP represent the inverting input (−) and the noninverting input (+) of the operational amplifier circuit respectively. PB, PBC, NB, and NBC represent terminals to which biased potentials are applied. "×d" (d is a positive integer) shown near each of the MOS transistors indicates a size of each transistor in a relative value as an example in designing the circuit. Amounts of current shown near the positive power source Vdd and the ground GND are also example of currents.

Since a structure of a folded-cascode-type operational amplifier circuit is a public knowledge, explanation is omitted. The operational amplifier circuits OP3 and OP4 are not limited to that of the folded cascode type, and may be of other types having different structures as long as the voltage amplification rate is sufficiently large.

According to the first embodiment, the coefficient can be set in more detail than the conventional technology without increasing the total number in unit capacitance. Therefore, it is possible to set the coefficient more precisely without increasing a silicon area to be occupied by the capacitors in the band gap circuit. Thus, the PTAT voltage can be generated with high accuracy, thereby increasing the accuracy of the reference voltage based on the PTAT voltage.

Figure 5:
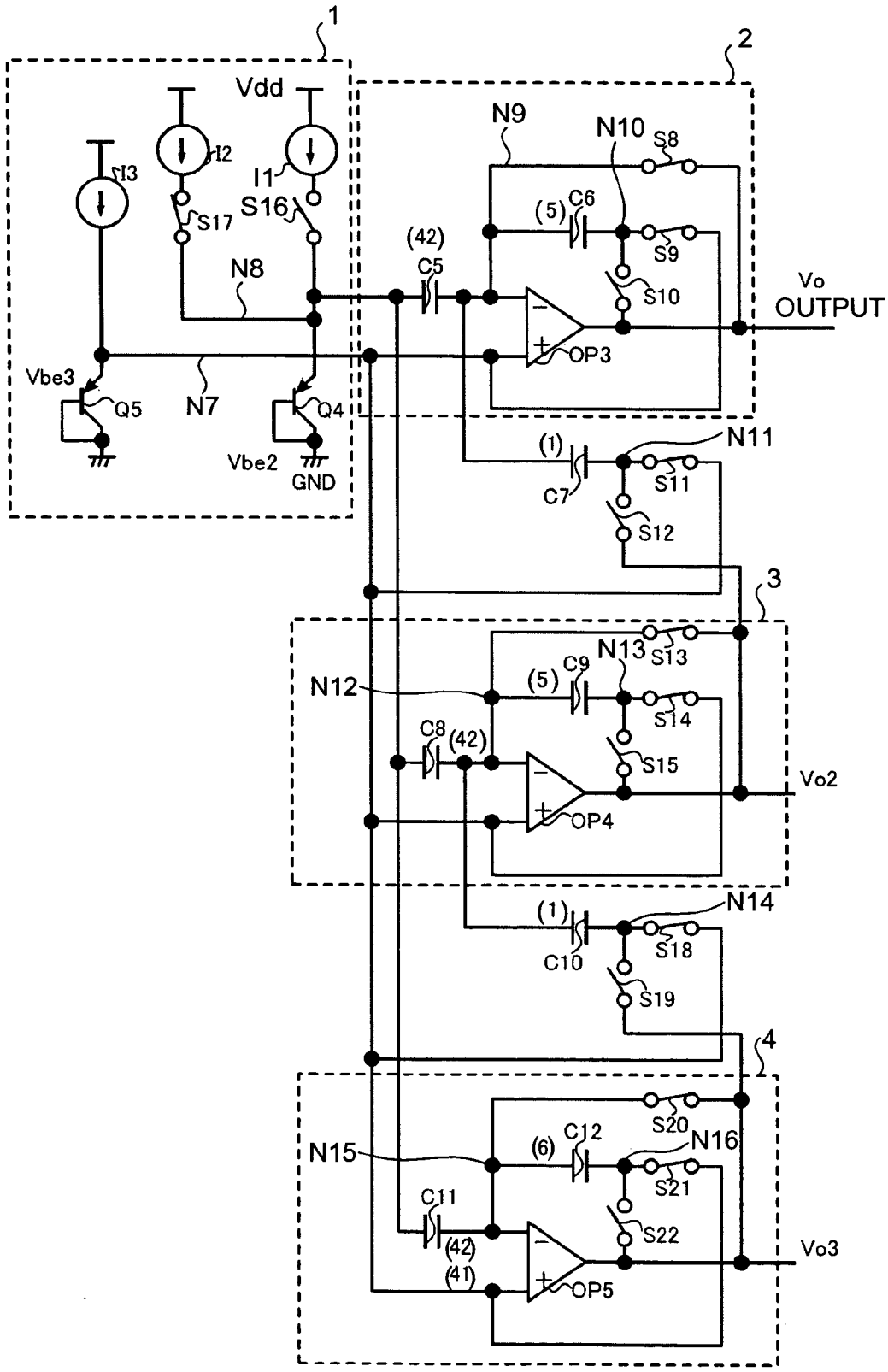
FIG. 5 is a circuit diagram of a band gap circuit according to a first embodiment of the present invention.

FIG. 5 is a circuit diagram of a band gap circuit according to a second embodiment of the present invention. As shown in FIG. 5, the band gap circuit according to the second embodiment further includes a third switched capacitor circuit 4 and a coupling capacitor C10 that couples the switched capacitor circuit C4 to the second switched capacitor circuit 3, in addition to other elements in the band gap circuit according to the first embodiment.

The third switched capacitor circuit 4 has the same structure as that of the first switched capacitor circuit 2. An operational amplifier circuit OP5, an input capacitor C11, a feedback capacitor C12, switches S20, S21, and S22 correspond to the operational amplifier circuit OP3, the input capacitor C5, the feedback capacitor C6, the switches S8, S9, and S10 in the bandbap circuit according to the first embodiment respectively. Nodes N15 and N16 correspond to the nodes N9 and N10.

An output of the operational amplifier circuit OPS is connected to the switch S19. The coupling capacitor C10 is connected between the switch S19 and an inverting input (−) of the operational amplifier circuit OP5. A capacitance of the coupling capacitor C10 is smaller than that of the feedback capacitor C9 in the second switched capacitor circuit 3. A node between the switch S19 and the coupling capacitor C10 is a node N14. A switch S18 is connected between the nodes N14 and N7, in other words, between each noninverting input (+) of the operational amplifier circuits OP3, OP4, and OP5.

Other structures are identical to that of the band gap circuit according to the first embodiment, therefore, like reference characters refer to like elements, and explanation is omitted. The operational amplifier circuit OP5 is, for example, of the folded cascode type shown in FIG. 4. The switches S18 to S22 are formed with, for example, MOS transistors.

In the following explanation of the band gap circuit shown in FIG. 5, C10, C11, and C12 represent capacitances of the coupling capacitor C10, the input capacitor C11, and the feedback capacitor C12. Moreover, Vo3 represents an output potential of the operational amplifier circuit OP5. Vo3 is a potential of the internal circuit required for generating Vo, together with Vo2. It is assumed that an offset voltage is zero in the operational amplifier circuits OP5.

As shown in FIG. 5, at the beginning, the switches S8, S9, S11, S13, S14 S17, S18, S20, and S21 are closed, and the switches S10, S12, S15, S16, S19, and S22 are open. In this condition, the potentials at the nodes N7, N10, N11, and N13 are Vbe3 as explained in the first embodiment. The potential of the node N8 is Vbe2. The potential of the node N9 is substantially Vbe3. The potential of the node N12 is substantially equal to the output voltage of the operational amplifier circuit OP4 to be approximately Vbe3.

Since the switch S20 is closed, the potential of the node N15 is equal to the output potential of the operational amplifier circuit OP5. Moreover, since the potentials of the nodes N7 and N15 are substantially equal, the potential of the node N15 is also approximately Vbe3.

In this state, the electrical charge qN9 to be accumulated at the node N9 is expressed as in Equation 15. The electrical charge qN12 to be accumulated at the node N12 is expressed as in Equation 16.

Since both of potentials at both ends of the coupling capacitor C10 are Vbe3, an electrical charge to be accumulated in the coupling capacitor C10 is zero. Since the potentials of the nodes N15 and N16 are equal to each other, an electrical charge to be accumulated in the feedback capacitor C12 is zero. Moreover, since the potential of the node N8 is Vbe2 and the potential of the node N15 is Vbe3, an electrical charge to be accumulated in the input capacitor C11 is (Vbe3−Vbe2)C8. Therefore, an electrical charge qN15 to be accumulated in the input capacitor C11 is expressed as $$qN15=(Vbe3-Vbe2)C11 \tag{22}$$

The switches S8, S9, S11, S13, S14, S17, S18, S20, and S21 are switched off to be open. Then, the switches S10, S12, S15, S16, S19, and S22 are switched on to be closed. Since the switches S8, S13, and S20 are switched to be open, the electrical charges at the nodes N9, N12, and N15 are conserved. In addition, the current I1 flows through the PNP bipolar transistor Q4. The base-to-emitter voltage of the PNP bipolar transistor Q4 is Vbe1.

When I2=j·I1 (where j is a coefficient, and I1<I2) and ΔVbe=Vbe2−Vbe1 are satisfied as in the first embodiment, Equation 17 is obtained as described in the first embodiment. If a gain of the operational amplifier circuit OP3 is sufficiently large, the output potential of the operational amplifier circuit OP3 is determined so that the electrical charge of the node N9 is conserved. Moreover, if a gain of the operational amplifier circuit OP4 is sufficiently large, the output potential of the operational amplifier circuit OP3 is determined so that the electrical charge of the node N12 is conserved. Since the electric potential at the node N7 remains to be Vbe3, if a gain of the operational amplifier circuit OP5 is sufficiently large, the electrical charge at the node N15 also remains to be Vbe3. The output potential of the operational amplifier circuit OP5 is determined so that the electrical charge of the node N15 is conserved.

Suppose that the electrical charge of the node N8 decreases by ΔVbe, and the output potential of the operational amplifier OP5 increases from Vbe3 to Vo3. If the electrical charge at the node N15 is acquired in this condition, supposing that the electrical charge qN15 of the node N15 in Equation 16 is conserved, the following Equation 23 is obtained.

$$(Vbe3-Vbe1)C11-(Vo3-Vbe3)C12=(Vbe3-Vbe2)C11 \tag{23}$$

When Equation 23 is solved for Vo3 where Vbe2−Vbe1=ΔVbe, the following Equation 24 is obtained.

$$Vo3=Vbe3+\Delta Vbe\times C11/C12 \tag{24}$$

Based on Equation 24, Vo3 can be determined. The electrical charge of the node N8 decreases by ΔVbe, and the output potential of the operational amplifier circuit OP5 increases from Vbe3 to Vo3 shown in Equation 24. Moreover, suppose that the output potential of the operational amplifier circuit OP4 increases from Vbe3 to Vo2. If the electrical charge of the node N12 is acquired in this condition, supposing that the electrical charge qN12 of the node N12 in Equation 16 is conserved, the following Equation 25 is obtained.

$$(Vbe3-Vbe1)C8-(Vo2-Vbe3)C9-(Vo3-Vbe3)C10=(Vbe3-Vbe2)C8 \quad (25)$$

When Equation 25 is solved for Vo2 where Vo3−Vbe3=ΔVbe×C11/C12, the following Equation 26 is obtained.

$$Vo2=Vbe3+\Delta Vbe\times C8/C9-\Delta Vbe\times(C10C11)/(C9C12) \quad (26)$$

Based on Equation 26, Vo2 can be determined. The electrical charge of the node N8 decreases by ΔVbe, and the output potential of the operational amplifier circuit OP4 increases from Vbe3 to Vo2 shown in Equation 26. Moreover, suppose that the output potential of the operational amplifier circuit OP3 increases from Vbe3 to Vo. If the electrical charge of the node N9 is acquired in this condition, supposing that the electrical charge qN9 of the node N9 in Equation 15 is conserved, Equation 20 described previously is obtained.

Since Vo2−Vbe3=ΔVbe×C8/C9−ΔVbe×(C10C11)/(C9C12) is obtained from Equation 26, when Equation 20 is solved for Vo, the following Equation 27 is obtained.

$$Vo=Vbe3+\Delta Vbe\times C5/C6-\Delta Vbe\times(C7C8)/(C6C9)+\Delta Vbe\times(C7C10C11)/(C6C9C12) \quad (27)$$

Based on Equation 27, Vo can be determined. By setting C5/C6, (C7C8)/(C6C9), and (C7C10C11)/(C6C9C12) appropriately, the circuit can be designed so as to obtain the output reference potential Vo of the operational amplifier circuit OP3 independent of temperature. In such a condition, Vo corresponds to a bandgap voltage of silicon, and is 1.2 V. Thus, according to the band gap circuit shown in FIG. 5, it is possible to obtain a reference voltage independent of temperature by appropriately setting the circuit constant. In addition, even if the total number in unit capacitance is equivalent to or smaller than that in the conventional circuits, the coefficient can be set in more precise value than in the conventional circuits.

In the following explanation of an example of setting the coefficient more precisely, it is assumed that the capacitance ratio required is 7:1 for the conveniences' sake, although the capacitance ratio to be required in an actual use varies depending on conditions. The capacitance of each capacitor is indicated in the brackets shown near each capacitor in FIG. 5.

When capacitances of the input capacitor C5, the feedback capacitors C6, the coupling capacitor C7, the input capacitor C8, the feedback capacitor C9, the coupling capacitor C10, the input capacitor C11, and the feedback capacitor C12 are 42, 5, 1, 42, 5, 1, 42, and 6 respectively, the total capacitance is 144. From Equation 27, the capacitance ratio by which ΔVbe is multiplied is C5/C6−(C7C8)/(C6C9)+(C7C10C11)/(C6C9C12). Therefore, the capacitance ratio is 42/5−(1×42)/(5×5)+(1×1×42)/(5×5×6)=8.4−4.68+0.28=7.

If the capacitance ratio should be modified as a result of measurement, the capacitance ratio can be modified by changing, for example, the capacitance of the capacitor C11 to 41. Thus, the capacitance ratio can be changed to 42/5−(1×42)/(5×5)+(1×1×41)/(5×5×6)=8.4−4.68+0.2733=6.9933. A difference between the capacitance ratios is |7−6.9933|=0.0067. Since the difference achieved in the conventional band gap circuit is 0.05 as explained in the first embodiment, this is approximately 1/7 of the difference in the case of the conventional band gap circuit shown in FIG. 2. In other words, in the band gap circuit according to the second embodiment, the coefficient, by which the thermal voltage (k·T/q) is multiplied, can be set in more precise value than that in the conventional band gap circuit.

According to the second embodiment, the coefficient can be set in more precise than the conventional technology without increasing the total number of unit capacitances forming each of the capacitors C5, C6, C7, C8, C9, C10, C11, and C12. Therefore, it is possible to set the coefficient more precisely without increasing silicon area to be occupied by the capacitors in the band gap circuit. Moreover, the coefficient can be set in more precise than a case in the first embodiment. Thus, the PTAT voltage can be generated with high accuracy, thereby increasing the accuracy of the reference voltage based on the PTAT voltage.

The various other embodiments are possible. For example, the voltage generating circuit 1, the first switched capacitor circuit 2, the second switched capacitor circuit 3, and the third switched capacitor circuit 4 can have configurations other than those explained above. Moreover, in a similar arrangement in which the third switched capacitor circuit 4 is connected to the second switched capacitor circuit 3, four or more switched capacitor circuits may be provided. The more the switched capacitor circuits are provided, in the more precise value the coefficient can be obtained, thereby increasing the accuracy of the reference voltage.

According to the embodiments described above, it is possible to set a coefficient, by which a thermal voltage k·T/q is multiplied, precisely without increasing silicon area to be occupied by capacitors in a circuit.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A band gap circuit that generates a reference voltage, comprising:

a voltage generating circuit configured to generate a voltage having negative temperature dependency;

a first switched-capacitor circuit including a first operational amplifier circuit having an input terminal and an output terminal;

a first input capacitor that is connected to the input terminal of the first operational amplifier circuit; and a first feedback capacitor that is connected to the input terminal and the output terminal of the first operational amplifier circuit;

a second switched-capacitor circuit including a second operational amplifier circuit having an input terminal and an output terminal;

a second input capacitor that is connected to the input terminal of the second operational amplifier circuit; and a second feedback capacitor that is connected to the input terminal and the output terminal of the second operational amplifier circuit; and a first coupling capacitor that capacitively couples the output terminal of the second operational amplifier circuit with the input terminal of the first operational amplifier circuit, wherein a thermal voltage, which is a voltage proportional to absolute temperature, is multiplied by a coefficient, and a multiplied thermal voltage is added to the voltage generated by the voltage generating circuit, the coefficient being determined based on capacitances of the first input capacitor, the first feedback capacitor, the first coupling capacitor, the second input capacitor, and the second feedback capacitor, wherein the first coupling capacitor is configured to have a capacitance smaller than a capacitance of the first feedback capacitor.

2. The band gap circuit according to claim 1, further comprising:

a third switched-capacitor circuit including a third operational amplifier circuit having an input terminal and an output terminal;

a third input capacitor that is connected to the input terminal of the third operational amplifier circuit; and a third feedback capacitor that is connected to the input terminal and the output terminal of the third operational amplifier circuit; and a second coupling capacitor that capacitively couples the output terminal of the third operational amplifier circuit with the input terminal of the second operational amplifier circuit so that capacitances are coupled, wherein the coefficient is determined further based on capacitances of the second coupling capacitor, the third input capacitor, and the third feedback capacitor.

3. The band gap circuit according to claim 2, wherein the second coupling capacitor is configured to have a capacitance smaller than a capacitance of the second feedback capacitor.

4. The band gap circuit according to claim 1, further comprising:

an x-th switched-capacitor circuit including an x-th operational amplifier circuit having an input terminal and an output terminal;

an x-th input capacitor that is connected to the input terminal of the x-th operational amplifier circuit; and an x-th feedback capacitor that is connected to the input terminal and the output terminal of the x-th operational amplifier circuit;

an (x−1)-th operational amplifier circuit; and an (x−1)-th coupling capacitor that capacitively couples the output terminal of the x-th operational amplifier circuit with the input terminal of the (x−1)-th operational amplifier circuit so that capacitances are coupled, where x is a positive integer that is equal to or larger than 4, wherein the coefficient is determined further based on capacitances of the (x−1)-th coupling capacitor, the x-th input capacitor, and the x-th feedback capacitor.

5. The band gap circuit according to claim 4, wherein the (x−1)-th coupling capacitor is configured to have a capacitance smaller than a capacitance of the x-th feedback capacitor.

6. The band gap circuit according to claim 1, wherein the voltage generating circuit generates a voltage so that a positive-negative junction is forward biased.

7. The band gap circuit according to claim 2, wherein each of the first operational amplifier circuit, the second operational amplifier circuit, and the third operational amplifier circuit includes an operational amplifier circuit of a folded cascode type.

* * * * *